US005127635A

United States Patent [19]

Long et al.

[11] Patent Number: 5,127,635

[45] Date of Patent: Jul. 7, 1992

[54] POCKETED CONTINUOUS WIRE MULTIPLE COIL SPRING BEDDING PRODUCT

[75] Inventors: Thomas P. Long, Carthage, Mo.; Henry R. Ramsey, Dudley, Mass.; John B. Schnake; Thomas J. Wells, both of Carthage, Mo.

[73] Assignee: Leggett & Platt, Incorporated, Carthage, Mo.

[21] Appl. No.: 523,123

[22] Filed: May 14, 1990

[51] Int. Cl.[5] ..... F16F 3/04; A47C 27/04

[52] U.S. Cl. ..... 267/91; 5/477

[58] Field of Search ..... 267/80, 81, 84, 87, 267/103, 89, 90, 94, 101; 5/248, 256, 477, 478, 480, 481

[56] References Cited

U.S. PATENT DOCUMENTS

| | | | |
|---|---|---|---|
| Re. 18,976 | 10/1933 | Jones | 5/477 |
| 1,455,847 | 5/1923 | Meutsch | 5/477 |
| 1,466,617 | 8/1923 | Foster | 5/477 |
| 2,634,800 | 4/1953 | Clark | 5/477 |
| 3,230,558 | 1/1966 | Duncan . | |
| 4,234,983 | 11/1980 | Stumpf . | |
| 4,358,097 | 11/1982 | Zapletal et al. | 267/101 |
| 4,451,946 | 6/1984 | Stumpf . | |
| 4,523,344 | 6/1985 | Stumpf et al. . | |
| 4,578,834 | 4/1986 | Stumpf . | |
| 4,766,624 | 8/1988 | Yates et al. | 5/256 X |
| 4,886,249 | 12/1989 | Docker et al. . | |
| 4,905,333 | 3/1990 | Scott | 5/248 X |
| 4,907,309 | 3/1990 | Breckle | 5/480 X |
| 4,960,267 | 10/1990 | Scott | 267/91 |

FOREIGN PATENT DOCUMENTS

| | | | |
|---|---|---|---|
| 348298 | 5/1931 | United Kingdom | 5/477 |
| 491523 | 9/1938 | United Kingdom | 5/477 |
| 2143731B | 11/1986 | United Kingdom . | |

*Primary Examiner*—Robert J. Oberleitner
*Attorney, Agent, or Firm*—Wood, Herron & Evans

[57] ABSTRACT

A pocketed coil spring assembly for use in the manufacture of mattresses or cushions or the like comprising a plurality of longitudinally extending strips of integrally connected closed fabric pockets each containing at least one helically coiled wire compression spring having its axis disposed transversely of the strip, and wherein each of the strips contains a single band of interconnected springs formed from a single length of wire into a plurality of interconnected helical coil springs. In the preferred embodiment of the invention, each strip of spring containing pockets is spaced from each adjacent strip by a ply of resilient foam material, and each of the plies of resilient foam material are secured to the sidewalls of adjacent strips.

7 Claims, 4 Drawing Sheets

POCKETED CONTINUOUS WIRE MULTIPLE COIL SPRING BEDDING PRODUCT

FIELD OF THE INVENTION

This invention relates to spring assemblies for mattresses, cushions and the like.

BACKGROUND OF THE INVENTION

A known form of spring assembly comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, a so-called continuous band of springs, is disclosed in U.S. Pat. No. 4,358,097 assigned to the assignee of this application. Another kind of band is disclosed in British patent No. 2,143,731. Both of the bands of springs disclosed in these two patents comprise a single length of spring wire shaped to form a plurality of individual coil springs arranged in a row, one end turn of each coil spring lying adjacent to a top face of the band, and the other end turn of each coil spring lying adjacent to a bottom face of the band. The coil springs of the band of springs disclosed in the above-identified U.S. patent are all of the same rotational hand, while the coil springs of the above-identified British patent are of a rotational hand opposite to the rotational hand of the adjacent coils in the same row. The adjacent coils of the bands of springs disclosed in both patents are interconnected to adjacent coils by a pair of interconnecting segments of wire integral with the coil springs. One of the pair of interconnecting segments is located in the bottom face of the band, and the other of the pair of interconnecting segments is located in the top face of the band.

When bands of springs of the type described hereinabove are assembled to form a spring interior, they are conventionally disposed side by side and interconnected by helical lacing wires, some of which lie in the top face of the spring interior and others of which lie in the bottom face thereof, the top and bottom faces of the spring interior being the faces defined by the top and bottom faces of the bands incorporated in the spring interior. Each helical lacing wire extends across the bands of springs and embraces portions of wires of the bands that extend transversely of the bands.

But, the presence of helical lacing wires in such continuous band spring assemblies can give rise to production problems and limit applications of the product. For example, the application of the helical lacing wires to the assembly must be performed mechanically in order to be practical, and such mechanical assembly can give rise to production machinery jams and production work stoppages. Furthermore, helical lacing wires in such a spring assembly can create undesirable noise and be a weak point in the assembly if the helical lacing wires are overstressed, bent, and caused to fracture. Furthermore, this assembly technique either requires that the bands of springs be assembled side by side in order to prevent voids between adjacent rows of spring coils, or, if the rows are spaced, results in holes or voids into which padding may fall and ultimately impair the appearance and comfort of the resulting product.

It has therefore been an objective of this invention to provide an improved continuous band spring assembly which eliminates the presence of the helical lacing wires and/or any other wire product for interconnecting the adjacent bands of coil springs.

Still another objective of this invention has been to provide an improved continuous band spring product which is quieter than prior art continuous band products because of the absence of the helical springs and the absence of any potential for coil springs of one band to rub against coil springs of adjacent bands and thereby give rise to noise.

SUMMARY OF THE INVENTION

The continuous band spring assembly of this invention which accomplishes these objectives comprises a plurality of bands of springs, each band of which is formed from a single length of wire formed into a plurality of parallel coil springs arranged in a row and interconnected by interconnecting segments of wire located alternately in the top and bottom faces of the band. Each band of springs is contained within a longitudinally extending strip of integrally connected closed fabric pockets, each pocket of which contains at least one helically coiled wire compression spring having its axis disposed transversely of the strip and wherein the pockets are defined between two overlapped plies of fabric strip by spaced transverse lines of attachment of the plies to one another and by connection of the plies together along spaced longitudinal lines. The strips of coil spring containing pockets are secured to intermediate plies of resilient foam material which extend for the full length and the full transverse height of the strips such that the strips are separated by the plies of resilient foam material which interconnect them to the adjacent strips.

The advantage of the pocketed continuous band spring assembly manufactured in accordance with this invention is that it provides a very quiet spring assembly and one which is relatively easy to manufacture on automated production equipment without the potential for jams and production breakdowns. It also, because of the presence of the resilient foam plies between adjacent strips of pocketed continuous bands of coil springs, has a desirable soft resilient feel. Furthermore, by varying the thickness of foam plies, the numbers of coils in a particular size spring assembly may be varied. Thereby, the firmness of the spring units may be easily varied from one spring assembly to another.

Yet another advantage of the pocketed continuous band spring assembly of this invention is that it prevents "shingling" or catching of one turn of a coil spring in the turn of an adjacent coil of the same band or adjacent band of coil springs. Once caught in the turn of an adjacent coil, the coil may not return to its original height and may create an unsightly blemish in the top surface of the resulting spring product assembly.

These and other objects and advantages of this invention will become more readily apparent from the following description of the drawings in which:

Figure 1:
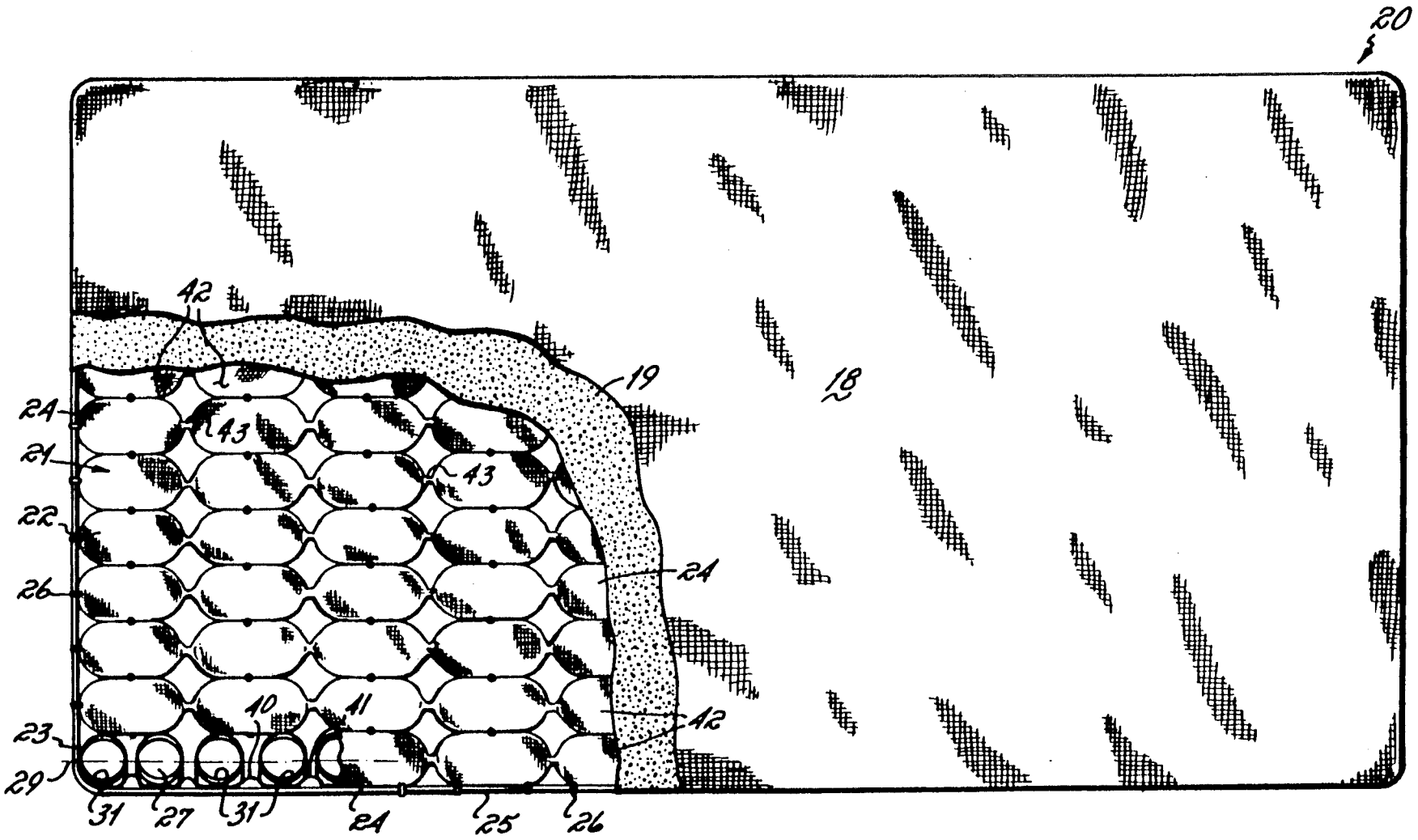
FIG. 1 is a top plan view, partially broken away, of a spring assembly embodying the invention of this application.
Figure 2:
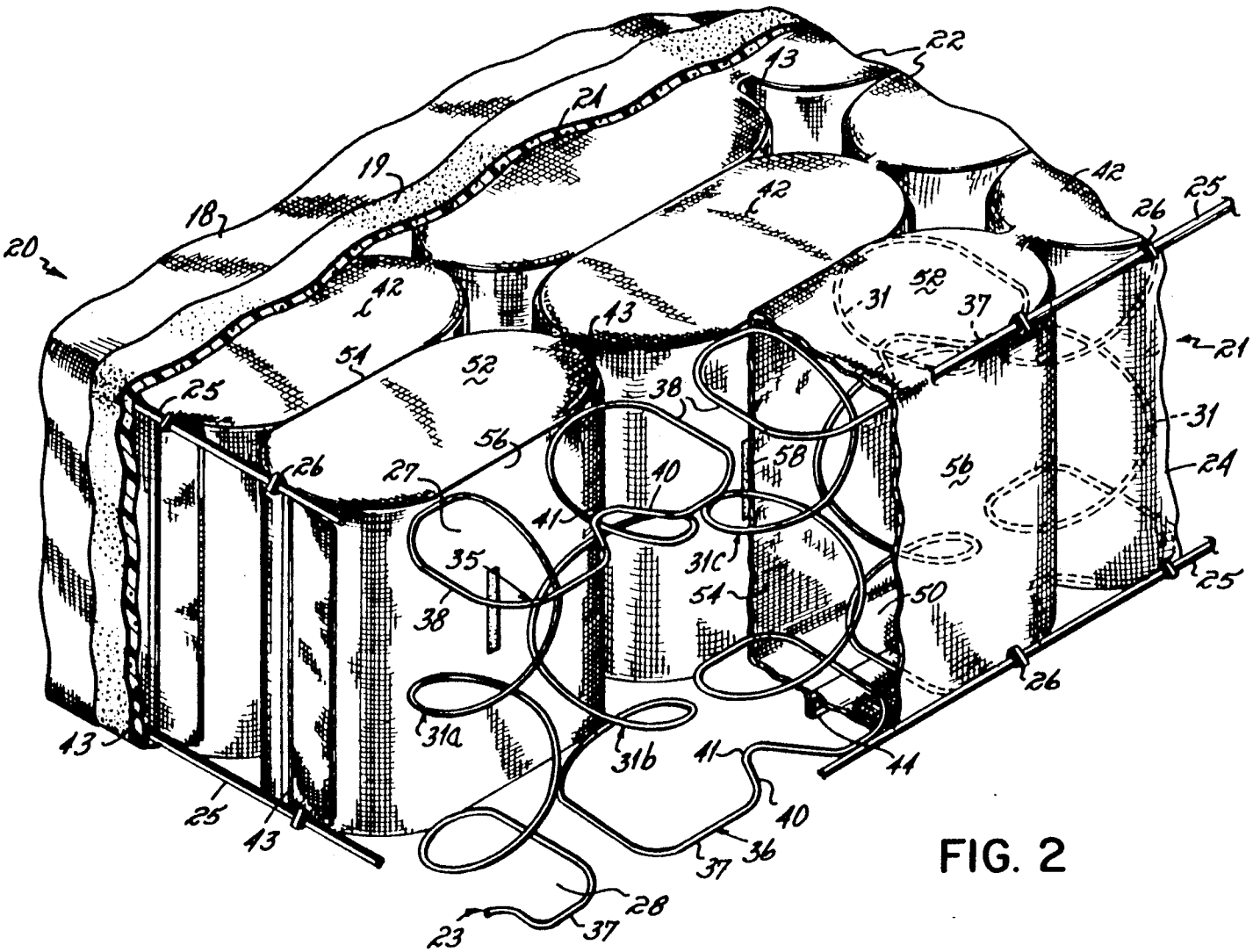
FIG. 2 is a perspective view, partially broken away, of one corner of the spring assembly of FIG. 1.

With reference first to FIGS. 1 and 2, there is illustrated a mattress 20 embodying the invention of this application. This mattress comprises a spring interior 21 on the top and bottom surfaces of which there is a pad 19. An upholstered covering 18 encases the spring interior 21 and the pads 19.

The spring interior 21 is formed from a plurality of longitudinally extending strips 22 of pocketed coil springs 31. Each strip 22 of pocketed coil springs 31 comprises a fabric covering 24 within which there is located a band of coil springs 23. These strips extend longitudinally of the mattress 20 and are secured to top and bottom border wires 25 by conventional hog rings 26. The border wires are located in the top and bottom planes of the mattress and extend completely around the periphery of the spring interior 21.

Each band 23 of coil springs 31, a portion of only one of which is illustrated in FIGS. 1 and 2, is made from a single length of spring wire shaped to form a plurality of individual coil springs 31 arranged in a row. Each band extends for the full length of the strip 22. Each coil spring 31 comprises about 2½ turns of wire with an axis which extends vertically perpendicular to the top and bottom faces of the band of springs 23 and the spring interior. The end turns of the coil springs 31 lie adjacent to the top and bottom faces 27, 28 of the band. Each coil spring 31 is so coiled as to have a rotational hand or direction of rotation opposite to the rotational hand of the adjacent coil springs of the same band. Each coil spring 31 is joined to the next adjacent coil spring by two interconnecting segments 35, 36 of the wire integral with the coil springs. One of the two interconnecting segments 35, 36 is in the top face 27 of the band 23, and the other is in the bottom face 28 thereof. For example, coil spring 31*a* (FIG. 2) is connected to coil spring 31*b* by interconnecting segment 35 which is in the top face 27 of the band, and the coil spring 31*b* is connected to coil spring 31*c* by interconnecting segment 36 which is in the bottom face of the band 28. Each interconnecting segment 35, 36 comprises a bridging portion 37, which extends longitudinally of the band or row of coil springs, and end portions 38, which extend in a direction normal to the longitudinal axis of the band 22. These end portions 38 of the interconnecting segments 35, 36 also lie in the top and bottom faces 27, 28 of the band 22.

In the band of coil springs 22 illustrated in FIGS. 1 and 2, the location of the intersection between each end of each coil spring 31 and the associated end portion 38 of the interconnecting segments 35, 36 is well defined because the coil springs are curved and the end portions 38 of the interconnecting segments are straight. In other constructions, however, the intersections may be less well defined because the end portions 38 of interconnecting segments 35, 36 may be replaced by arcuate extensions of the coil springs 31; in those last cases, the interconnecting segments must be considered as consisting solely of the bridging portions 37.

Each bridging portion 37 of each band of springs, in addition to extending longitudinally of the band, also has a generally V-shaped supporting structure 40 extending laterally thereof. This supporting structure 40 lies in the top and bottom faces 27, 28 of the band 22 and extends inwardly toward the center of the band from the remainder of the bridging portion 37 of which it forms a part. Each V-shaped supporting structure or indentation 40 lies half way between or medially of the end portions 38 of the interconnecting segment 35, 36 of which it forms a part, and it extends from one side of the band approximately half way toward the other side thereof such that the apex 41 of each band is located very nearly on the longitudinal center line 29 (FIG. 1) of the band of springs and, coincidentally, on the same longitudinal center line of the strip 22 of pocketed coils within which the band of coil springs is contained.

The method of manufacturing and the apparatus for manufacturing the band of springs illustrated in FIGS. 1 and 2 is completely described and illustrated in British patent No. 2,143,731, the disclosure of which is hereby incorporated by reference for purposes of completing the disclosure of this application.

In prior art practice, after formation of the rows of coil springs 22, it has been common practice to interconnect the bands or rows of coil springs by lacing them together by means of helical lacing wires. Such helical lacing wires are eliminated, though, according to the practice of this invention.

In accordance with the invention of this application, each band of coil springs 23 is encased within a folded two-ply strip of non-woven fabric of thermoplastic fibers in which the individual spring pockets 42 are defined between the plies by transverse lines 43 of discrete thermal welds of the plies to one another and in which the pockets 42 are closed by a longitudinal seam 44 of a similar thermal weld. As an alternative to the use of thermal welds, the longitudinal seams 44 which extend for the length of the strips 22 and the transverse thermal welds 43 which extend for the full height or transverse dimension of the strips may be replaced by sewn seams or by ultrasonic welding of the seams or even by adhering the two plies together to form the pockets. Of course, the particular fabric chosen for each of these different seam forming techniques would be determined by the nature of the seam to be employed to form the pockets. For example, if the pockets are to be sewn, a cotton fabric or a cotton blended fabric or any polyolefin-type fabric could be employed. Alternatively, if the seams are to be formed by ultrasonic welding of the two plies of fabric, the fabric must contain fibers which melt and become thermoplastic in response to the application of ultrasonic welding techniques.

In accordance with the practice of the invention of this application, the transverse seams between the pockets 42 are located on the longitudinal center line 29 of each strip 22 of pocketed coil springs 31. In order to so position the seam, the bridging portion 37 of the interconnecting segments 36 must extend inwardly for a substantial distance from the side edge of the strip of pocketed coil springs. By positioning the apex 41 of the supporting structure 40 near the center line of the longitudinal strip, the seam 43 between adjacent pockets 42 may be located on the longitudinal center line 25 of the strip without being forced to the edge of the strip, as would be the case if the bridging portion 37 were straight without the V-shaped indentation formed by the supporting structure 40.

The pockets 42 in accordance with one practice of this invention each contain two coils 31 and a single interconnecting segment 36 between those two coils of each pocket. Thus, in this embodiment, the bottom two turns of each coil, as well as the interconnecting segment 36 of the two coils, is supported and contained by the bottom wall 50 of the pocket 42 while the top turns and, in the case of alternate pockets, the top interconnecting segment 35 of the coils, are contained within and supported by the top wall 52 of the pocket 42. Additionally, each pocket 42 of this embodiment is defined by the sidewalls 54, 56 which are generally flat, except at the ends where they have arcuate end portions 54*a*, 54*b* and 56*a*, 56*b*, respectively. Because the sidewalls have a large, flat area defined between the arcuate ends 56*a*, 56*b*, 54*a*, 54*b*, those flat surfaces facilitate adhesion of the strips one to the other when the strips are placed in juxtaposition and secured together. In one preferred embodiment, the strips are secured together either by beads of adhesive, such as conventional hot melt adhesive beads, or by an atomized spray adhesive applied to the flat surfaces 54, 56 of adjacent strips of pocketed coil springs. The adhesive 58 may be either a conventional sprayed liquid adhesive or a sprayed hot melt adhesive.

As an alternative to placement of two coils within each pocket 42 of a strip 22 of coil springs 31, each pocket could contain only a single coil or could contain as many as three coils. Furthermore, the adjacent strip of fabric could be secured together by ultrasonic welding, as well as by adhering of the strip together.

After the rows or strips of pocketed coil springs 22 are secured together by securement of the side surfaces 54, 56 to the side surfaces of adjacent strips and a sufficient number of those strips have been adhered together to extend for the full width of a mattress, the spring interior 21 is completed by securement of the border wires 25 on the top and bottom edges of the spring interior 21. Thereafter, the mattress 20 is completed by placement of the pads 19 over the top and bottom surfaces of the spring interior 21, and the complete spring interior, including the pads, are encased within conventional ticking or upholstered covering material.

Figure 3:
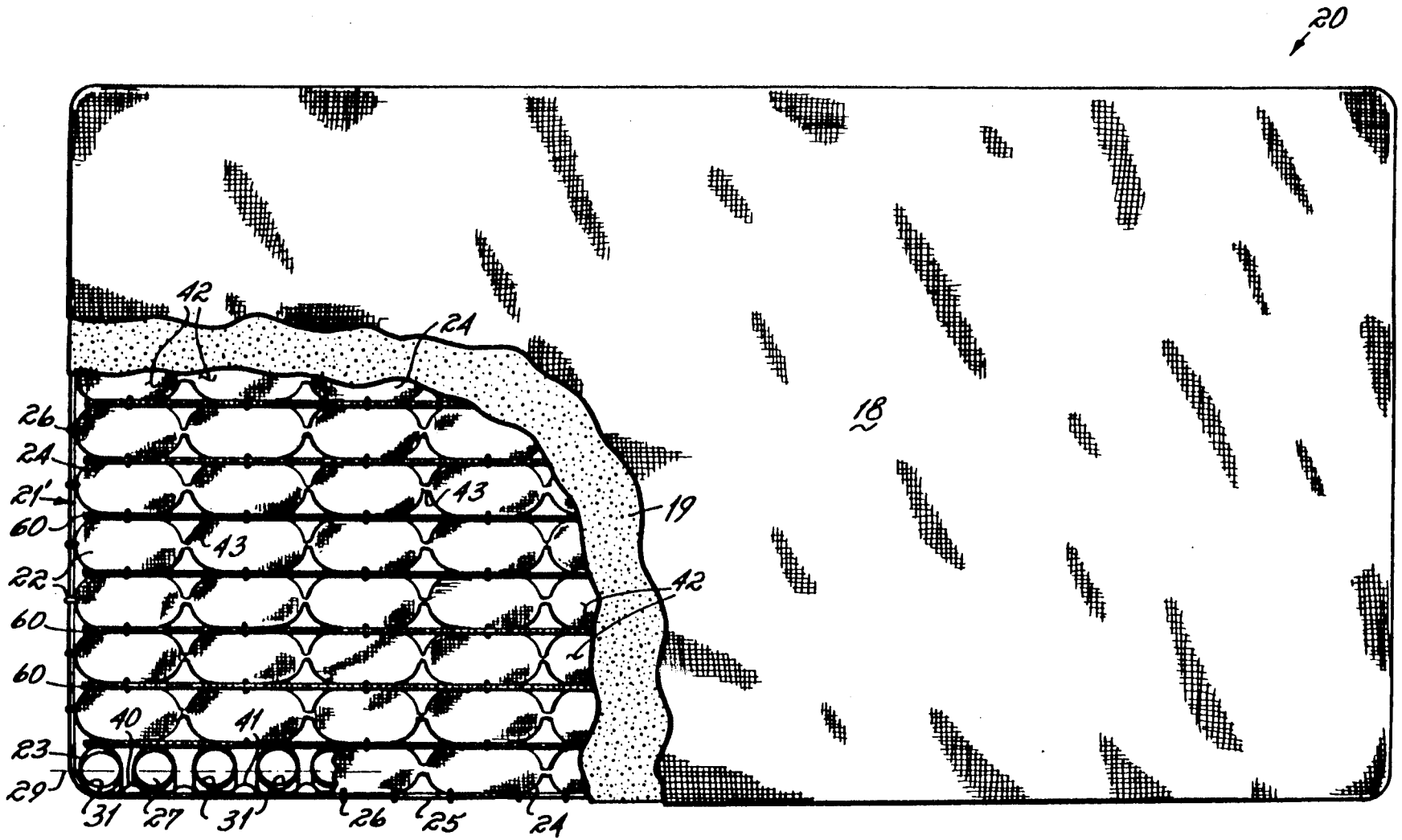
FIG. 3 is a top plan view, partially broken away, of a second embodiment of a spring assembly incorporating the invention of this application.
Figure 4:
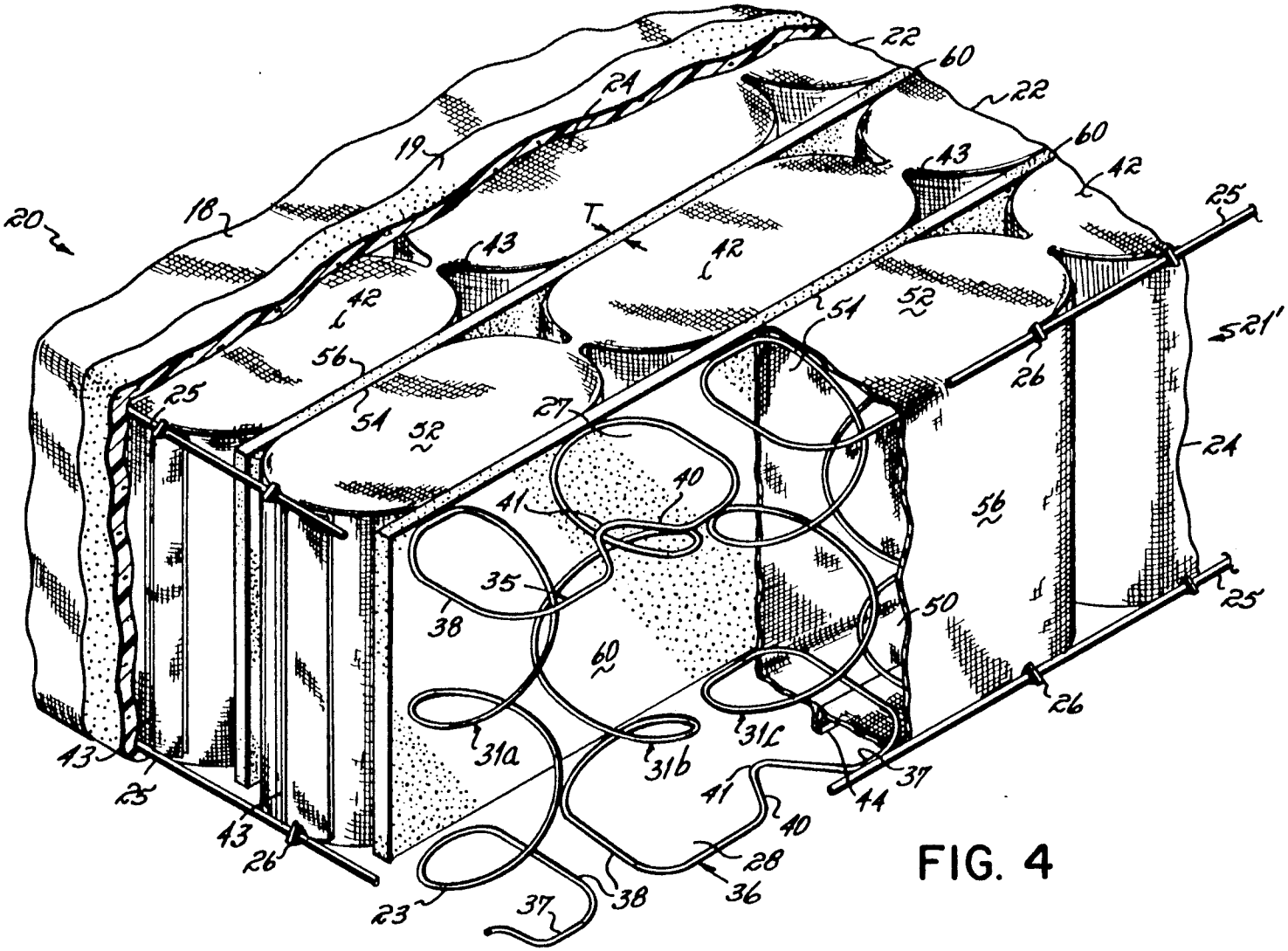
FIG. 4 is a perspective view, partially broken away, of the second embodiment of the spring assembly illustrated in FIG. 3.

With reference now to FIGS. 3 and 4, there is illustrated a second preferred embodiment of this invention. This embodiment is identical to the embodiment of FIGS. 1 and 2, except that it includes, as a part of the spring interior 21', foam pads or foam plies 60 positioned between each of the strips 22 of pocketed springs and adhered or otherwise secured to the sidewalls 54, 56 of the strips. In this embodiment, each ply of foam material extends for the full length of the strip and is of the approximately the same height as the transverse dimension of the strip. In one preferred embodiment, the strip is approximately three centimeters in thickness, but this dimension may be varied depending upon the desired resiliency and coil count of the resulting product.

The pies of resilient foam material may be made from conventional urethane foam or any other resilient foam material of the type from which foam mattresses or foam cushions and pillows are conventionally made. In the preferred practice of this invention, these foam plies 60 are adhesively secured to the sidewalls 54, 56 of the strips of pocketed coil springs 22 by either beads of hot melt adhesive or adhesive sprayed onto the surface of the foam and/or the exterior sidewalls 54, 56 of the strips so as to permanently secure the foam pads to the exterior surfaces of the sidewalls of the strips.

The advantage of having foam pads or plies of resilient foam 60 between the individual strips 22 of pocketed coil springs 31 is that there is a substantial savings in wire utilized in the mattress, cushion, or product embodying the spring interior, and the resulting product may be manufactured less expensively than the embodiment of FIGS. 1 and 2. Additionally, the resulting product may be easily varied in firmness by varying the thickness T of foam plies 60 in the resulting product, and the product may thereby have a softer or more resilient feel.

While we have described only two embodiments of our invention, persons in the art to which it is applicable will appreciate numerous changes and modifications which may be made without departing from the spirit of our invention. For example, the invention has been illustrated and described as having the multiple spring coils of a band or row of pocketed spring coils formed from a single continuous wire in the manner illustrated and described in British Patent No. 2,143,731 wherein the adjacent coils of a row of coils are of the opposite rotational hand and are interconnected by a longitudinally extending bridging portion which is located on one side or edge of the row. The band or row of spring coils could just as well, though, be formed in the manner described in U.S. Pat. No. 4,358,097 wherein the adjacent coils are all of the same rotational hand and are interconnected by a head or interconnecting segment which extends from one side of the row to the other between adjacent coils. Other changes, such as in the width or percentage of the top or bottom surface areas of the spring unit which are occupied by the foam pads or plies 60, could readily be made and are contemplated as being within the scope of the claims of this application. Therefore, I do not intend to be limited except by the scope of the following appended claims:

We claim:

1. A series of pocketed springs for use in the manufacture of bedding and seating products comprising a longitudinally extending strip of integrally connected closed fabric pockets each containing at least one helically coiled wire compression spring having its axis disposed transversely of the strip, and wherein said pockets are defined between two overlapped piles of fabric strip by spaced transverse lines of attachments of the piles to one another and by connection of said plies along spaced longitudinal lines, and each helically coiled compression spring contained in said strip being formed from and part of a longitudinally extending band of springs disposed side by side and connected together in the top and bottom faces of the band, said band of springs being formed from a single length of wire formed into a plurality of transversely extending parallel coil springs, each of said coil springs having an axis, said coil springs being arranged in axial alignment with the axes of the coil springs of a band of springs being located in a common longitudinal plane, said coil springs of each band being arranged in a row and interconnected by interconnecting segments of wire located alternately in the top and bottom faces of the band, and each of said interconnecting segments comprising a longitudinally extending bridging portion of the band of springs which extends lengthwise of the row and a pair of endmost portions which extend transversely from opposite ends of the bridging portion.

2. The series of pocketed springs of claim 1 wherein each of said longitudinally extending bridging portions of said band of springs has a generally V-shaped transversely extending supporting section located approximately medially of the length of said bridging portions, said V-shaped supporting sections extending transversely inwardly from one side of said band and having and apex of said V-shaped supporting section located approximately on the center line of said strip.

3. The series of pocketed springs of claim 1 wherein at least some of said spaced transverse lines of attachment of the plies of fabric to one another are located on the longitudinal center line of said strip and embraces a portion of the interconnecting segments between adjacent coils of said band.

4. The series of pocketed springs of claim 1 wherein some of said pockets contain a pair of compression springs interconnected by an interconnecting segment of said band.

5. A pocketed coil spring assembly having a plurality of longitudinally extending strips of integrally connected closed fabric pockets, each pocket of each strip containing at least one helically coiled wire compression spring having its axis disposed transversely of the strip, and wherein said pockets are defined between two overlapped plies of fabric strip by spaced transverse lines of attachments of the plies to one another and by connection of said plies together along spaced longitudinal lines, and each helically coiled compression spring contained in each strip being formed from and being part of a longitudinally extending band of springs disposed side by side and connected together in the top and bottom faces of the band, said band of springs being formed from a single length of wire formed into a plurality of parallel coil springs, each of said coil springs having an axis, said coil springs being arranged in axial alignment with the axes of the coil springs of a band of springs being located in a common longitudinal plane, said coil springs of each band being arranged in a row and interconnected by interconnecting segments of wire located alternately in the top and bottom faces of the band, each of said interconnecting segments comprising a longitudinally extending bridging portion of the band of springs which extends lengthwise of the row and a pair of endmost portions which extend transversely from opposite ends of the bridging portion, and each coil spring of a band of springs being of a hand opposite to the hand of the adjacent coil springs of the band immediately before and after it in the row.

6. The pocketed coil spring assembly of claim 5 wherein each strip of spring containing pockets is separated from each adjacent strip by a ply of resilient foam material.

7. The pocketed coil spring assembly of claim 6 wherein said plies of resilient foam material extend from approximately the full length and transverse dimension of said strips.

* * * * *

UNITED STATES PATENT AND TRADEMARK OFFICE

CERTIFICATE OF CORRECTION

PATENT NO. : 5,127,635

DATED : July 7, 1992

INVENTOR(S) : Thomas P. Long et al

It is certified that error appears in the above-identified patent and that said Letters Patent is hereby corrected as shown below:

Column 5, line 51, "pies" should be --plies--.

Column 6, line 37, "piles" should be --plies--.

Column 6, line 39, "piles" should be --plies--.

Column 6, line 40, before "along", insert --together--.

Column 7, line 1, "and" should be --an--.

Signed and Sealed this

Twenty-eighth Day of September, 1993

Bruce Lehman

*Attest:*

BRUCE LEHMAN

*Attesting Officer*

*Commissioner of Patents and Trademarks*